US012161902B1

(12) United States Patent
Whiteley

(10) Patent No.: US 12,161,902 B1
(45) Date of Patent: Dec. 10, 2024

(54) ADJUSTABLE BODY WEIGHT EXERCISE RACK

(71) Applicant: Paul James Whiteley, Elk Grove, CA (US)

(72) Inventor: Paul James Whiteley, Elk Grove, CA (US)

( * ) Notice: Subject to any disclaimer, the term of this patent is extended or adjusted under 35 U.S.C. 154(b) by 0 days.

(21) Appl. No.: 17/741,221

(22) Filed: May 10, 2022

Related U.S. Application Data

(60) Provisional application No. 63/201,781, filed on May 12, 2021.

(51) Int. Cl.
*A63B 21/00* (2006.01)

(52) U.S. Cl.
CPC .... *A63B 21/00047* (2013.01); *A63B 21/4033* (2015.10); *A63B 2225/093* (2013.01)

(58) Field of Classification Search
CPC ..... A63B 1/00; A63B 3/00; A63B 23/1209–1227; A63B 21/06–169
See application file for complete search history.

(56) References Cited

U.S. PATENT DOCUMENTS 3,948,513 A * 4/1976 Pfotenhauer ..... A63B 17/04 482/142
4,306,715 A * 12/1981 Sutherland ..... A63B 21/078 482/104
4,555,107 A * 11/1985 Otto ..... A63B 3/00 482/42
5,042,800 A * 8/1991 Walter ..... A63B 23/03575 482/145
5,306,220 A * 4/1994 Kearney ..... A63B 23/00 482/99
5,346,448 A * 9/1994 Sollo ..... A63B 21/00181 482/99
7,309,303 B1 * 12/2007 Proctor ..... A63B 3/00 482/141
9,192,804 B2 * 11/2015 Inglut ..... A63B 21/151
9,427,611 B1 8/2016 Balentine
9,492,701 B1 * 11/2016 Bognatz ..... A63B 21/072
9,713,741 B1 7/2017 Tolliver
10,143,298 B2 * 12/2018 Wood ..... A47B 47/0008
10,188,906 B2 * 1/2019 Haas ..... A63B 17/04
10,441,841 B2 * 10/2019 Biddix, Jr. ..... A63B 21/4035
10,471,293 B2 * 11/2019 George ..... A63B 1/00
10,576,322 B2 * 3/2020 Schlegel ..... A63B 23/1227
D945,540 S * 3/2022 Pritchett ..... D21/686
11,273,337 B2 * 3/2022 George ..... A63B 1/00
11,446,535 B1 * 9/2022 Iverson ..... A63B 17/00
11,707,662 B1 * 7/2023 Schroeder ..... A63B 21/06 52/126.6

(Continued)

*Primary Examiner* — Nyca T Nguyen

(57) ABSTRACT

One embodiment of a steel adjustable body weight exercise rack consists of a left and right pair of vertical uprights that are attached opposite one another along a base consisting of two parallel base tubes. A lower and upper pair of horizontal bars are attached across each pair of vertical uprights. The horizontal bars adjust up-and-down along the vertical uprights, and the vertical uprights adjust side-to-side along the base tubes. Three dimensional adjustments to the improved body weight exercise device allow the user to manipulate their body with and across the horizontal bars to perform virtually unlimited variations of body weight exercises.

1 Claim, 4 Drawing Sheets

(56) References Cited

U.S. PATENT DOCUMENTS

| | | | | |
|---|---|---|---|---|
| 2007/0032357 | A1* | 2/2007 | Piane, Jr. | A63B 69/222<br>482/142 |
| 2014/0087928 | A1* | 3/2014 | Luedeka | A63B 21/4023<br>482/130 |
| 2014/0135182 | A1* | 5/2014 | Inglut | A63B 23/1227<br>482/96 |
| 2016/0023035 | A1* | 1/2016 | Meyer | A63B 1/00<br>482/38 |
| 2017/0189736 | A1* | 7/2017 | Martin | E04H 12/22 |
| 2017/0304678 | A1 | 10/2017 | Shade | |
| 2018/0036573 | A1* | 2/2018 | Lennox | A63B 21/012 |
| 2018/0221700 | A1* | 8/2018 | George | A63B 23/0355 |
| 2019/0247701 | A1* | 8/2019 | Sergakis | F16B 45/00 |
| 2019/0329117 | A1* | 10/2019 | Lloyd | A63B 1/005 |
| 2019/0351273 | A1* | 11/2019 | Shan | A63B 21/068 |

* cited by examiner

ADJUSTABLE BODY WEIGHT EXERCISE RACK

CROSS-REFERENCE TO RELATED APPLICATIONS

This application claims the benefit of provisional Patent Application Ser. No. 63/201,781, filed May 12, 2021 by the present inventor, which is incorporated by reference in its entirety.

FEDERALLY SPONSORED RESEARCH

None.

SEQUENCE LISTING

None.

BACKGROUND

This is regarding an adjustable exercise device that enables users to perform virtually unlimited variations of body weight exercises, such as pull ups, push ups, dips, rows, squats, lunges, and leg raises. People are drawn to body weight exercises because they offer natural, convenient, and effective means for building strength and endurance.

Body weight exercises are typically performed on multiple independent devices, such as pull up, dip, push up, and row stations commonly seen in public parks. Different types of independent body weight exercise devices are also created for home or gym use, such as pull up bars affixed to beams or doorways, and push up and dip stands positioned on the ground. Other devices merge multiple stations into single pieces of equipment, such as towers for pull ups, push ups, dips, and Roman chair leg raises.

The main limitations of existing body weight exercise devices is that they lack variability in the types and ways that exercises can be performed. For example, U.S. Pat. No. 9,427,611B1 to Balentine discloses an adjustable pull up bar that mounts to a ceiling or wall. Variability is limited because users are restricted to one main body-weight exercise, the pull up. In addition, with only one pull up bar, users can only perform a few pull up variations, such as close-to wide-grip pull ups; disregarding numerous variations that are possible with two adjustable bars positioned at various heights and distances from one another.

There are similar limitations among existing push up devices. For example, Patent US20170304678A1 to Shade describes an exercise apparatus that provides users with variability for performing traditional push-ups. Users of this device can grab handles on the ground and perform close-to wide-grip push-ups. However, the apparatus only provides variability for push-ups performed on the ground, ignoring push-ups from multiple angles, such as incline, decline, and inverted push-ups. In addition, Shade's device does not allow users to perform other exercises, such as pull-ups and rows.

People can overcome the limitation of only being able to perform one main body weight exercise per device by utilizing multiple body weight exercise devices, like pull up, push up, and dip stations (e.g., U.S. Pat. No. 9,427,611B1 to Balentine; Patent US20170304678A1 to Shade). However, individuals using multiple body weight exercise devices at home would need to purchase and store several different pieces of equipment, which may be cost and space prohibitive. In addition, some of these devices need to be attached to structures, like ceilings, walls, and doorways, which can cause structural damage. People can also utilize multiple body weight exercise devices at public parks; though, the parks may not be conveniently located, are susceptible to inclement weather and crowds, and the equipment typically does not adjust to provide users with greater variability.

Body weight exercise enthusiasts can also purchase and use devices that combine multiple stations into a single piece of equipment, such as towers for pull ups, push ups, and dips (e.g., U.S. Pat. No. 9,713,741B1 to Tolliver). Still, such devices are limited to few exercises that can only be performed in fixed positions due to a lack of adjustable parts, thereby restricting body weight exercise variability.

There is a need for a single, fully adjustable, body weight exercise device that can be used in public spaces, homes, gyms, or offices that provide virtually unlimited variations of body weight exercises. As far as I am aware, no single body weight exercise device formerly developed provides seamless adjustability to allow the user to perform virtually unlimited variations of body weight exercises, such as pull ups, push ups, dips, rows, squats, lunges, and leg raises.

SUMMARY

An improved body weight exercise device includes two opposing horizontal bars (similar to pull up bars) that are adjusted up and down along two sets of vertical uprights. The two sets of vertical uprights are adjusted side to side along a base. Three dimensional adjustments to the improved body weight exercise device allow users to perform virtually unlimited variations of body weight exercises. A few examples should make the functionality of the adjustable body weight exercise device clear.

Pull ups, which are typically performed with a single bar at a fixed height, can now be performed with one or two bars at various heights and distances from each other. For example, users can adjust the two horizontal bars so they are parallel to one another, grab one with each hand and perform various pull up variations, from close grip to wide grip, with hands placed at various orientations and positions along the bars. Users can also adjust the horizontal bars at different heights and distances from each other so pull ups can be performed with one hand holding one bar that is lower than the other hand holding the other bar, with further variation added by placing the hands at different orientations and positions along the bars. Thus, the user can perform virtually unlimited variations of the standard pull up exercise by using one horizontal bar or adjusting the two horizontal bars of the exercise device up and down, forward and back, and by positioning their hands at various positions and orientations along the bars.

Similarly, this improved body weight exercise device affords virtually unlimited variations of push up, press, and row exercises. Users can perform push ups by holding and pressing into one horizontal bar adjusted at various heights while their feet are on the other horizontal bar adjusted at various heights; thereby, allowing the user to perform the push up exercise at all possible angles, from incline push ups from the nearly upright position to decline push ups from the nearly inverted position. Users can also perform shoulder press exercises by completely inverting the body while holding and pressing into the horizontal bars with their head dipping above and below the bars.

Body weight rows from various angles can likewise be performed by holding and pulling the torso into one horizontal bar at various heights while the feet rest on the other horizontal bar at different heights. Thus, the user can perform body weight rows from nearly upright positions to completely inverted. Further variation can be added by changing the position and orientation of the hands along the bars.

Users can also perform a wide range of leg exercises. For example, users can perform step up or supported box jump exercises by stepping or jumping onto one horizontal bar at various heights while holding onto the other horizontal bar placed in a higher position for stability. Users can also hold onto the horizontal bars for stability while performing single-legged squats or lunges between them. Users can also affix standard attachments to holes in the vertical uprights and base to create a squat rack for performing squats, lunges, and any other barbell exercise. This device enables the users to use their creativity to perform virtually unlimited variations of exercises.

DETAILED DESCRIPTION

FIG. 1 is a perspective view from the corner of the adjustable body weight exercise device. The bottom of the exercise device (FIG. 1) is a rectangular base (11, 12) that include two rectangular base tubes (11) that make up the long sides of the base and two rectangular base strips (12) that make up the short sides. The two rectangular base tubes (11) that make up the long sides of the base are preferably made of steel and measure 3"×3" wide and 90" long, with ⅝" diameter holes that cross through two opposing sides, spaced 2" apart. The two rectangular strips (12) that make up the short sides of the base are preferably steel, measuring 49" long×3" wide and 1.5" tall. The ends of the rectangular base tubes (11) are attached at right angles on top of the ends of two base rectangular strips (12), preferably with eight equally spaced 4"×⅝" bolts (two bolts per each of the four connection points).

FIG. 2 is an underside-view, focusing on the lower portion of one side of the exercise device. As can be seen more clearly in FIG. 2, the two base tubes (11) run through the center of the four base connectors (13). The four base connectors (13) are preferably rectangular steel tubing that are large enough so the base tubes (11) can fit through, preferably measuring 3.2"×3.2" wide and 12" long.

Also shown in FIG. 2, affixed to the bottom portion of each base connector (13) are three roller cases (14*a*) that are preferably rectangular and measure 3.2"×1.2". Within each of the roller cases (14*a*) includes a cylindrical roller (14*b*) measuring 3" long and 1" diameter. The rollers (14*b*) are attached to roller cases (14*a*) with roller rods (14*c*). The cylindrical roller rods (14*c*) are preferably 3.2" long×0.5" diameter steel rods that run through the center of the rollers (14*b*) and are welded to the sides of a roller case (14*a*). The function of the rollers (14*b*) is to allow the base connectors (13) to roll and adjust along the base tubes (11) they are attached to.

As can also be seen in FIG. 2, the base connectors (13) can lock into place along the base tubes (11) with base connector pins (15). The left base connector (13) in FIG. 2 is locked in place with a connector pin (15) and the right base connector (13) is unlocked. The top portion of the base connector pins (15) are shaped to wrap around the contours of the base connectors (13) and the lower portion include the two pins preferably made of solid steel, 3" long×⅝ diameter. The pins (15) go through the ⅝" holes in the base connectors (13) and the base tubes (11) so the base connectors (13) can lock into place at the desired location along the length of the base tubes (11).

As shown in FIG. 1, affixed to the base connectors (13), preferably by welding, are a left pair of vertical uprights (16) and a right pair of vertical uprights (17). The two pairs of vertical uprights (16, 17) are preferably the same size and material as the rectangular base tubes (11): steel, measuring 3×3" wide and 90" long, with ⅝" diameter holes that cross through two opposing sides, spaced 2" apart. One vertical upright in a pair (16, 17) adjusts along one base tube and the other vertical upright in the pair (16, 17) adjusts along the opposite base tube (11).

FIG. 3 shows a close up view of the vertical uprights (16, 17). Attached to the vertical uprights (16, 17) are four bar connectors (18). The bar connectors (18) are locked into place along the vertical uprights (16, 17) at the desired position with bar connector pins (19). As shown in FIG. 3, a bar connector (18) is locked into place along the right vertical upright (17) and another bar connector (18) is just outside the left vertical upright (16) in an unlocked position.

The bar connectors (18) are wide enough to adjust over the vertical uprights (16, 17), and are preferably square steel tubing measuring 3.25"×3.25". The bar connector pins (19) are shaped to fit around the contours of the bar connectors (18) so the pins (19) can be easily locked into place and removed from the bar connectors (18). The bar connector pins (19) are preferably steel with a 3⅓"×3⅓" U-shaped base, and a 3" long×1" diameter strip extending perpendicularly from the center of one of the three sides of the U-shaped base, and a ⅝" diameter by 3⅓" length pin attached to the strip.

As shown in FIG. 1, a lower pair of horizontal bars (20) and an upper pair of horizontal bars (21) are attached perpendicularly between opposing bar connectors (18), preferably by welding. The horizontal bars (20, 21) are preferably round solid steel, 43" long and 1.25" diameter. The lower pair of horizontal bars (20) adjust up and down along the lengths of the vertical uprights (16, 17), by locking the bar connector pins (19) into the bar connectors (18) and vertical uprights (16, 17) at the desired position. The primary purpose of the lower pair of horizontal bars (20) are to provide the user with a means for performing the majority of body weight exercises. The upper pair of horizontal bars (21) preferably connect across the top holes of each pair of vertical uprights (16, 17). The main function of the upper pair of horizontal bars (21) is to provide stability for the top portion of the vertical uprights (16, 17) and to perform some body weight exercises, such as pull-ups.

Operation

In operation (FIG. 4), one can perform numerous variations of body weight exercises by adjusting the vertical uprights (16, 17) side to side along the base tubes (11), the lower horizontal bars (20) up and down along the vertical uprights (16, 17), and the user's body, hand, and/or feet along the lower and/or upper horizontal bars (20, 21). The rollers (14*b*, FIG. 2) on the bottom of the base connectors (13) allow the base connectors (13) and the attached vertical uprights (16, 17) to roll and adjust to the desired position along the base tubes (11). The base connectors (13) are locked into place at the desired position along the base tubes (11) by inserting the base connector pins (15) through the holes at the top of the base connectors (13) and through the holes in the attached base tubes (11).

The lower and upper pairs of horizontal bars (20, 21) can be adjusted up and down along the pairs of vertical uprights (16, 17) by sliding the bar connectors (18) over the vertical uprights to the desired position. The bar connectors (18) are locked into place over the vertical uprights (16, 17) with the bar connector pins (19; FIG. 3). That is, each bar connector pin (19) can be oriented 90-degrees so its U-shaped base is parallel to the vertical uprights (16, 17), and then the bar connector pins (19) are able to slide through the ⅝" holes in the bar connectors (18) and the attached vertical uprights (16, 17). Once the base connector pins (15) are positioned through the base connectors (13) and, vertical uprights (16, 17), the bar connector pins (19) are oriented back 90-degrees, so they are flush against the bar connectors (18; FIG. 3).

Several examples of body weight exercises are possible with the positioning of the adjustable exercise device shown in FIG. 4. A user can perform incline push ups by grabbing the right horizontal bar (20) with their hands and pushing their chest away from it while their body is in a plank position and their feet are placed on the left horizontal bar (20) for stability. Similarly, the user can perform incline body weight rows by situating their body in a plank position so they are looking toward the ceiling or sky, grabbing and pulling their body toward the right horizontal bar (20) with their hands while their feet are placed on the left horizontal bar (20) for stability.

With the same positioning of the adjustable exercise device shown in FIG. 4, decline push ups and rows can be performed in the same manner except the user grabs the left horizontal bar (20) with their hands and places their feet on the right horizontal bar (20). Further variation can be added by changing the orientation and placement of the hands and feet. Note that these multiple examples apply to the same positioning of the lower horizontal bars (20) and vertical uprights (16, 17) in FIG. 4. Virtually unlimited variations are possible among many types of exercises by adjusting the horizontal bars (20, 21), vertical uprights (16, 17), and body, feet, and hand positions.

CONCLUSION, RAMIFICATIONS, AND SCOPE

Thus the reader will see that at least one embodiment of the adjustable body weight exercise rack provides users with a comprehensive and convenient device for performing virtually unlimited variations of traditional and non-traditional body weight exercises. While existing body weight devices, such as pull up, push up, and dip stations limit users to few exercise variations, the adjustable body weight exercise rack allows unlimited possibilities for body weight training in one convenient device.

While my above description contains many specificities, these should not be construed as limitations on scope, but rather as an exemplification of one of many embodiments thereof. The above description includes preferences for sizes, shapes, and materials, but many other embodiments are possible. For example, the base tubes (11) and vertical uprights (16, 17) can be cylindrical instead of rectangular or solid instead of tubular. The base (11, 12), vertical uprights (16, 17), and horizontal bars (20, 21) can be longer, shorter, wider, or thinner than what is described. The body weight exercise rack can also be constructed from materials other than steel, such as Fiber Reinforced Plastics (FRP), fiberglass, or wood.

There can be more or less than two pairs of vertical uprights (16, 17) and four horizontal bars (20, 21) to allow greater variation of exercises or fewer components. The holes for the base connector pins (15) and bar connector pins (19) can be smaller or larger than ⅝" diameter. In addition, the base connector pins (15) and bar connector pins (19) can be secured into position magnetically and be of different forms and shapes.

Accessories can be affixed to the holes in the base tubes (11) and vertical uprights (16, 17), such as J-hooks and spotter arms, for performing weight training exercises, like squats, bench press, and military press. Gymnastics rings and elastic bands can also be attached to the body weight exercise rack to perform even more exercises. Accordingly, the scope should not be determined by the embodiment(s) illustrated, but by the appended claims and their legal equivalents.

REFERENCE NUMERALS

11—Base tube
12—Base strip
13—Base connector
14*a*—Roller case
14*b*—Roller
14*c*—Roller rod
15—Base connector pin
16—Vertical upright, left pair
17—Vertical upright, right pair
18—Bar connector
19—Bar connector pin
20—Horizontal bar, lower pair
21—Horizontal bar, upper

FIGURES

Figure 1:
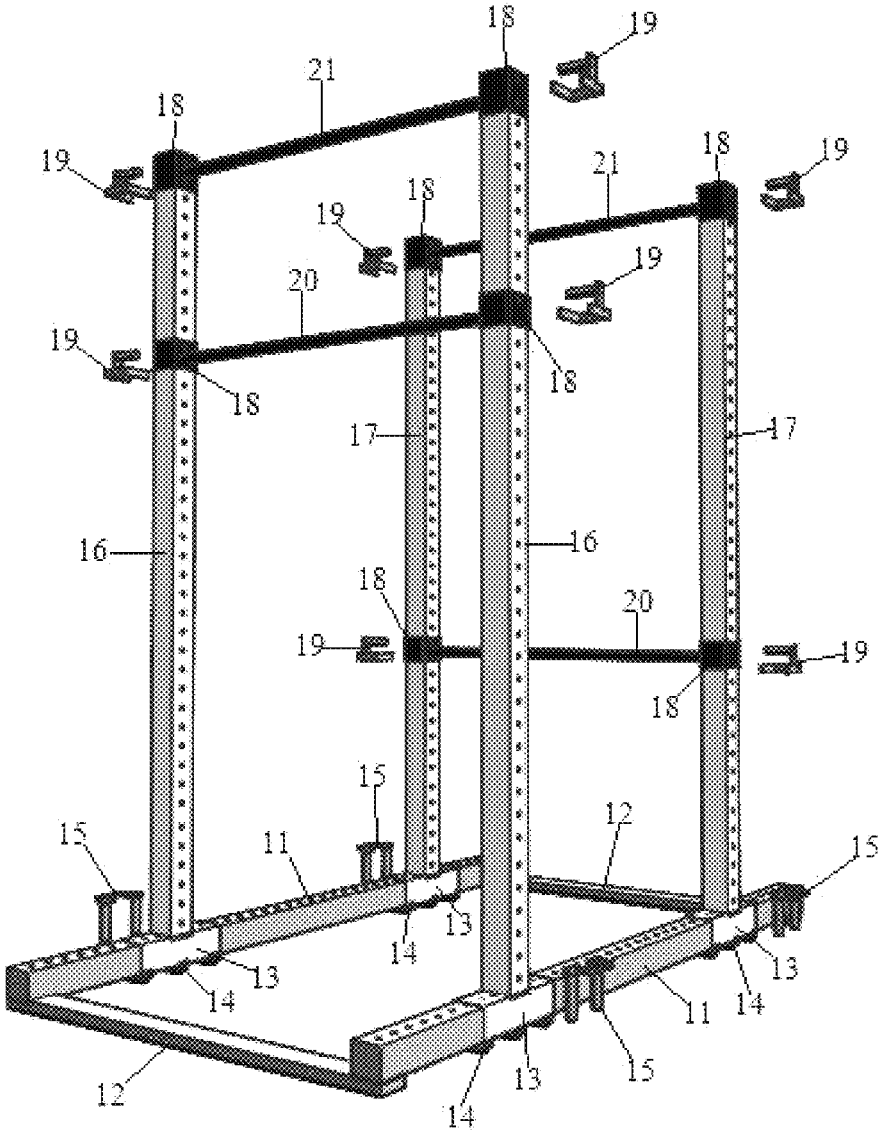
FIG. 1 is a perspective corner-side view of the adjustable body weight exercise device constructed in accordance with the invention.
Figure 2:
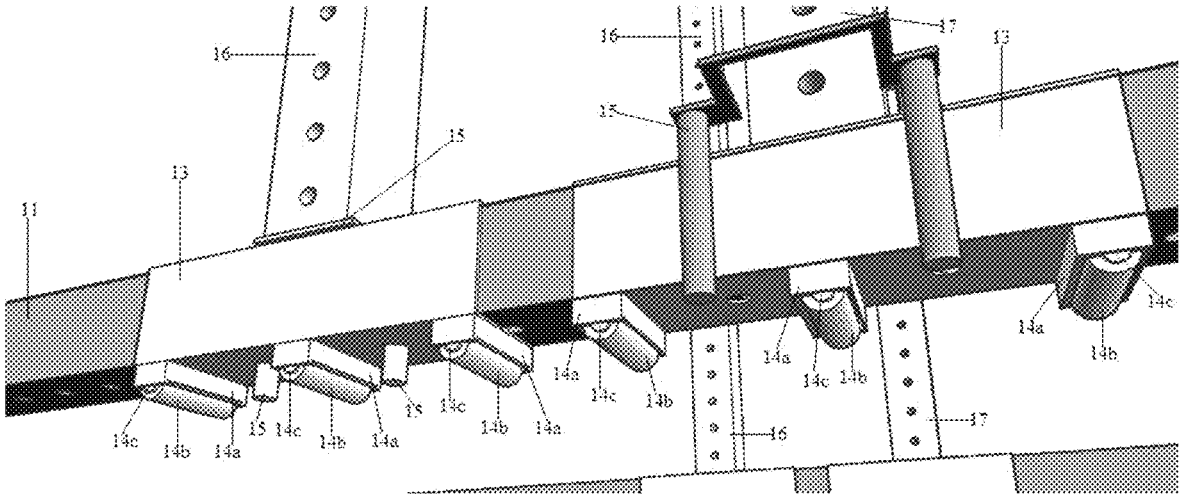
FIG. 2 is a perspective underside-view of the adjustable body weight exercise device, focusing on the lower adjustable portion of the device.
Figure 3:
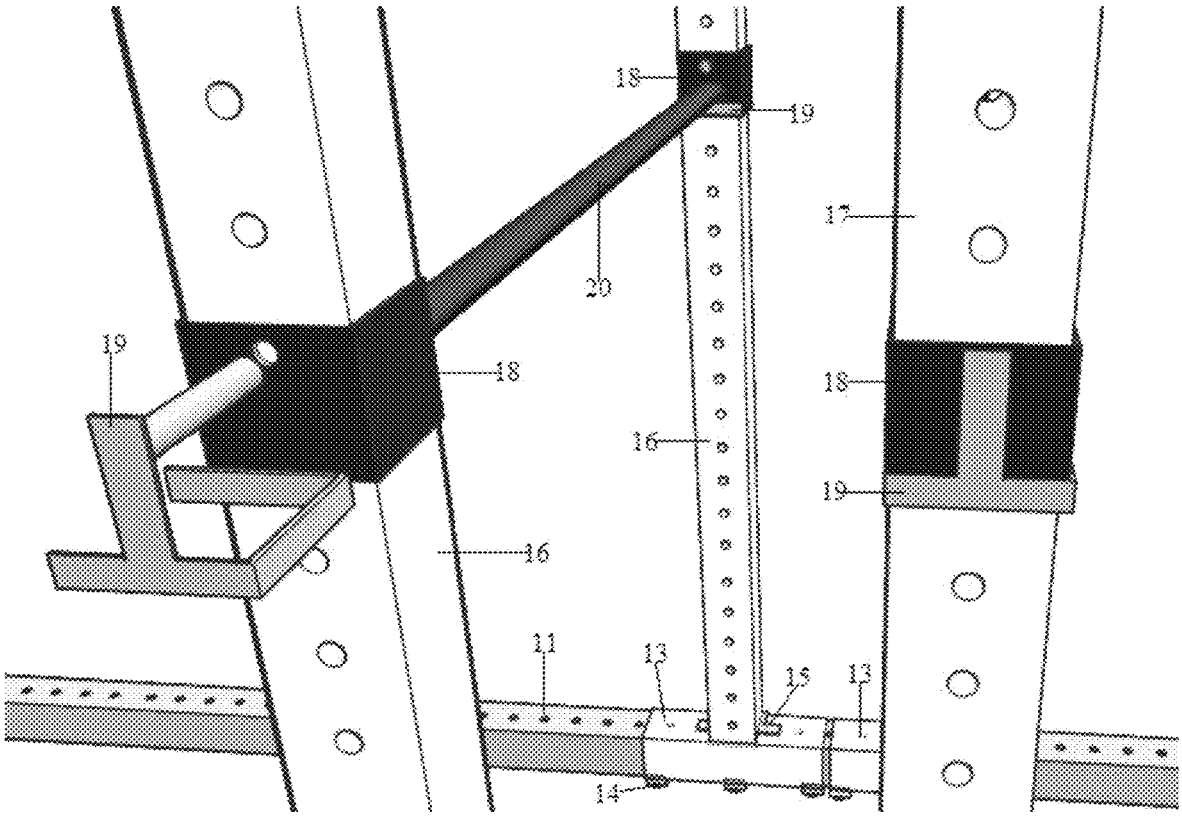
FIG. 3 is a perspective side-view of the adjustable body weight exercise device, focusing on the adjustable aspects of the horizontal bars.
Figure 4:
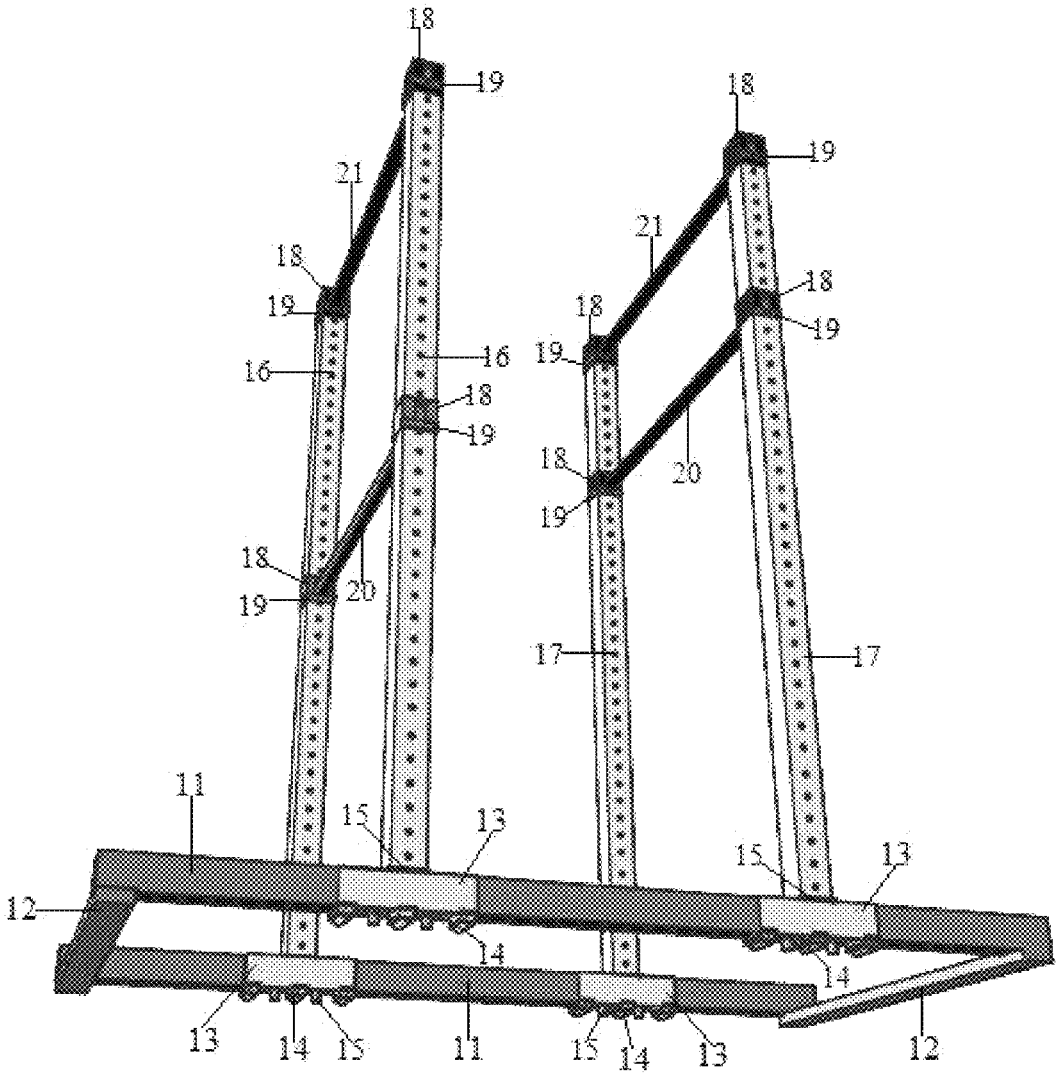
FIG. 4 is a perspective underside-view of FIG. 1, with the components of the adjustable body weight exercise device in the locked position.

The invention claimed is:

1. An exercise device, comprising:

a) a plurality of vertical uprights of equal and sufficient size to accommodate a human being for performing exercises;

b) a plurality of horizontal bars of equal and sufficient size to accommodate use by the human being for performing exercises;

c) a base comprising a plurality of horizontal supports positioned near the ground;

d) bar connectors for joining the horizontal bars at right angles to the vertical uprights such that each horizontal bar is configured to be adjusted along the height of the vertical uprights;

e) base connectors for joining the vertical uprights at right angles to the base such that the vertical uprights are configured to be adjusted along the length of the base; and f) bar connector pins shaped to fit around contours of the bar connectors, wherein each bar connector pin has a U-shaped base, a strip extending perpendicularly from the center of one of three sides of the U-shaped base, and a pin attached to the strip.

* * * * *